US006056622A

United States Patent [19]

Chung

[11] Patent Number: 6,056,622

[45] Date of Patent: May 2, 2000

[54] BALLS WITH UNPREDICTABLE BOUNCE

[76] Inventor: Chang I. Chung, 2483 Whitehall Ct., Schenectady, N.Y. 12309

[21] Appl. No.: 08/490,435

[22] Filed: Jun. 12, 1995

Related U.S. Application Data

[63] Continuation of application No. 08/178,726, Sep. 7, 1993.

[51] Int. Cl.[7] ..... A63H 17/00; A63B 37/00; A63B 37/10

[52] U.S. Cl. ..... 446/435; 473/594; 473/595

[58] Field of Search ..... 446/431, 437, 446/486, 491; 273/DIG. 20, 58 F, 58 A, 58 B, 58 BA, 58 H, 59 B, 60 B, 65 ED, 29 R; 473/126, 591, 594, 595

[56] References Cited

U.S. PATENT DOCUMENTS

| | | | |
|---|---|---|---|
| 567,459 | 9/1896 | Elwell | 273/58 BA |
| 712,412 | 10/1902 | Richards | 273/58 BA |
| 1,436,028 | 11/1922 | Flemming | 273/58 A X |
| 1,466,609 | 8/1923 | Weaver | 273/58 B |
| 1,651,960 | 12/1927 | Miller | 446/491 |
| 1,873,221 | 8/1932 | Senn | 473/594 |
| 2,209,877 | 7/1940 | Ferngren . | |
| 2,301,506 | 11/1942 | Bean | 446/431 X |
| 3,181,864 | 5/1965 | Rolke | 473/126 |
| 3,241,834 | 3/1966 | Stingley | 473/595 X |
| 3,400,929 | 9/1968 | Fabinich | 473/126 |
| 3,603,023 | 9/1971 | McHugh | 446/431 |
| 3,995,855 | 12/1976 | Schultz | 273/58 F |
| 4,101,617 | 7/1978 | Friederich | 264/93 |
| 4,268,034 | 5/1981 | MacDonald | 473/126 |
| 4,434,195 | 2/1984 | Skostins | 427/387 |
| 4,463,951 | 8/1984 | Kumasake et al. | 273/58 A |
| 4,598,909 | 7/1986 | Ventura et al. | 473/594 |
| 4,842,563 | 6/1989 | Russell | 446/437 X |
| 4,865,911 | 9/1989 | Blizzard | 428/285 |
| 5,093,053 | 3/1992 | Eckardt et al. | 264/45.1 |
| 5,106,933 | 4/1992 | Kobayashi et al. | 528/15 |
| 5,210,156 | 5/1993 | Clark et al. | 525/477 |

FOREIGN PATENT DOCUMENTS

| | | | |
|---|---|---|---|
| 2508804 | 1/1983 | France | 473/FOR 157 |
| 2508854 | 1/1983 | France | 273/58 A |
| 67929 | 1/1893 | Germany | 273/58 A |
| 2639749 | 3/1978 | Germany | 273/29 R |
| 2744475 | 4/1979 | Germany | 473/126 |
| 3915818 | 11/1990 | Germany | 446/431 |
| 710666 | 4/1966 | Japan | 473/126 |
| 738119 | 10/1955 | United Kingdom | 273/58 BA |
| 179444 | 5/1992 | United Kingdom | 446/437 |

*Primary Examiner*—D. Neal Muir
*Attorney, Agent, or Firm*—Furgang & Adwar, LLP

[57] ABSTRACT

Unpredictable bounce characteristics are imparted to a ball by forming the ball as a composite wherein a second ball part is disposed within a first ball part with the centers of each ball part spaced one from the other. In a first embodiment the second ball part is of the relatively high bounce ball type that is disposed in a cavity formed in the first ball part which is fabricated from sponge-like rubber; with the second ball part center spaced from the first ball part center. In a second embodiment the first ball part is of the relatively high bounce ball type and the second ball part is an air filled cavity formed within the first ball parts with the center of the cavity spaced from the center of the first ball part. The composite balls may be formed by severing the first ball part, forming the cavity therein and either leaving the cavity empty or placing a second ball part of different characteristics than the first ball part within the cavity.. A silicone glue is utilized to reassemble and secure the severed first ball part. Alternatively, gas can be injected into the first ball part while it is molded to form the empty cavity therein.

11 Claims, 1 Drawing Sheet

BALLS WITH UNPREDICTABLE BOUNCE

This is a continuation of copending application Ser. No. 08/178,726 filed on Sep. 7, 1993.

BACKGROUND OF THE INVENTION—FIELD OF APPLICATION

This invention relates to balls utilized in playing and training for fun and sports activities; and more particularly to balls with unpredictable bounce characteristics.

BACKGROUND OF THE INVENTION—DESCRIPTION OF THE PRIOR ART

Ball playing is a common every day activity for adults as well as for children. Quite often the activity is carried out by two or more people throwing or bouncing the ball to each other. In many instances the child or adult plays with the ball by themselves; bouncing the ball on a nearby surface and catching the ball as it rebounds. The surface may be the ground or floor or it can be a wall, flight of steps or the like.

Catching re-bounding balls may also be good practice for a person training for a sports activity such as baseball, softball or similar ball game. The person throws the ball against the wall or other surface and catches the ball on its rebound. There are even balls manufactured with characteristics that facilitate a training use by having their weight, size, shape and hardness varied to accommodate the desired training activity. Some training ball may even be fabricated to provide a significantly higher rebound characteristic than a regulation ball.

However, most balls and even training balls are symmetrically fabricated and provide a predictable bounce. The user can readily predict how the ball will bounce and the return flight path for the ball depending upon how and where they initially throw the ball. That predictability lessens the value to the player of the training activity. The predictability of the path of flight of a rebounding ball will also lessen the fun of merely playing with a ball possibly producing boredom and ending the play activity. An inability to predict and anticipate the return flight of a rebounding ball should increase the excitement and activity of playing with a ball and should result in a more difficult practice and improve fielding skills for a ball training activity.

Balls with unpredictable movement characteristics, purportedly to make play more interesting and exciting, are described and shown in United States and foreign patented literature. For example, U.S. Pat. No. 996,458 patented on Jun. 27, 1911 to A. R. Coleman for "Game Apparatus" shows and describes a number of different ball constructions but wherein the balls have only their rolling characteristics rendered unpredictable and then only when they are rolling in the proximity of one or more permanent magnets. The Coleman balls are hollow and are not constructed to be bounced. U.S. Pat. No. 3,106,397 patented on Oct. 8, 1963 to F. S. Lacey for "Ball Toy", on the other hand, provides a relatively complex ball construction requiring thrust members that, upon impact of the ball against a surface, project outwardly to direct the ball into an unpredictable flight path; providing what must be a relatively expensive and undesirable ball construction.

U.S. Pat. No. 454,544 patented on Jun. 23, 1891 to C. E. Goodspeed for "Loaded Toy Ball" shows and describes a ball with erratic movement characteristics but incorporated into a ball that is to be rolled and which is hollow and has a lead weight fixedly positioned against an inner surface of the hollow ball. F. C. Scholly, on the other hand, in his U.S. Pat. No. 1,629,364 patented on May 17, 1927 for "Ball" provides a molded hollow ball with a weight molded in fixed disposition against an inner wall of the hollow ball but only for the purpose of facilitating the throwing of curved balls.

German patent 829,109 patented on Jan. 21, 1952 to F. Bartels provides a hollow ball with a weight suspended by straps; while U.S. Pat. No. 4,915,669 patented to G. K. Russell on Apr. 10, 1990 for "Ball With Swingable Internal Weight" provides a hollow air filled ball with a thin necked inner chamber to be filled with a substance other than air. However, air filled balls can be deflated and, as such, may not be acceptable especially for rigorous training practice.

W. O. Leslie in U.S. Pat. No. 4,986,540 patented on Jan. 22, 1991 for "Erratically Movable Inflated Game Ball" and German Publication DE 333-214-A of Oct. 31, 1984, both show hollow balls with a fluid inside occupying a relatively small amount of the hollow space and which is movable within the hollow space. Here again, such balls can be deflated and may not be suitable for the rigors of ball training activities. Alternatively, A. Prokupek in his U.S. Pat. No. 5,048,829 patented on Sep. 17, 1991 for "Amusement Ball" describes and shows a ball core covered by two figure "8" sections one of which is thicker than the other purportedly to provide unusual bounce and flight paths; but which may due to the irregularity of the surface, present undesirable grip characteristics.

SUMMARY OF THE INVENTION

It is therefore an object of this invention to provide new and novel balls.

It is another object of this invention to provide new and novel balls with unpredictable bounce characteristics.

It is yet another object of this invention to provide new and novel sports activity training balls.

It is still another object of this invention to provide new and novel sports activity training balls with unpredictable bounce characteristics.

It is a further object of this invention to provide new and novel play activity balls.

It is yet a further object of this invention to provide new and novel play activity balls with unpredictable bounce characteristics.

It is yet still a further object of this invention to provide new and novel composite balls wherein a first ball component is disposed within a second ball component.

It is yet still a further object of this invention to provide new and novel composite ball constructions wherein first ball components with first bounce characteristics are imbedded within second ball components with second bounce characteristics that are different than the first bounce characteristics.

Other objects, features and advantages of the invention in its details of construction and arrangement of parts will be seen from the above and from the following description of the preferred embodiments when considered with the drawing and from the appended claims.

BRIEF DESCRIPTION OF THE PREFERRED EMBODIMENT

Figure 1:
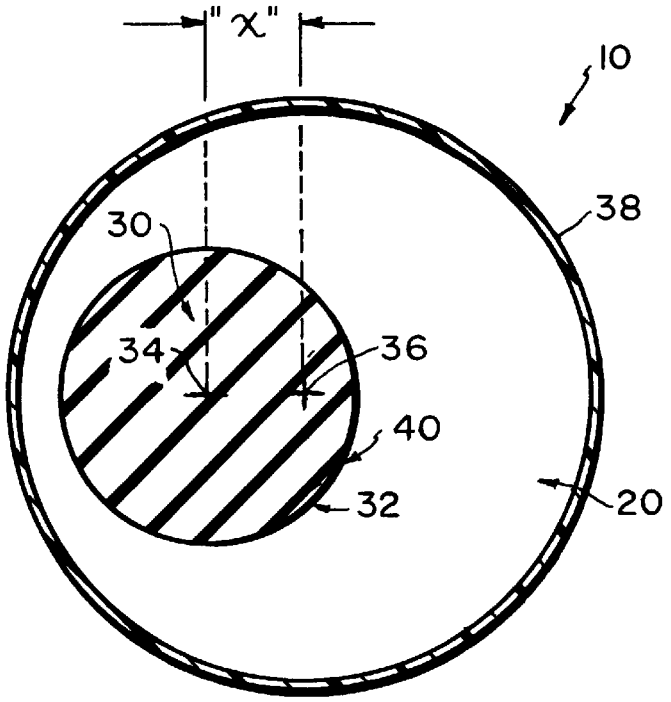
FIG. 1 is a schematic of a composite ball incorporating the instant invention.

With reference to FIG. 1 there is generally shown at 10 a composite ball incorporating the instant invention. A first component or ball part 20 of composite ball 10 comprises a conventional sponge ball of the type that might be used to play, practice or train with for baseball. Ball part 20 is made of plastic foam material and is of a size and weight suitable and appropriate for the intended use. Ball 20, for example, may be 6.8 to 6.95 cm in diameter, 23.3 grams in weight and 0.137 gr/cc in density. While ball 20 has been described as being made from foam plastic and with the size, weight and density characteristics set out hereinabove other appropriate materials, sizes, weights and densities may be utilized. Ball 20 when dropped from 149 cm onto a marble floor rebounds at about 18 cm.

A second component or ball part 30 is imbedded within first ball part 20 at a location 32 such that the center 34 of ball part 30 is spaced from the center 36 of ball part 10 by a predetermined distance "x"; which, in this instance, is about one-third of the distance between center 36 of ball part 20 and the surface 38 of ball part 20 or as it may be otherwise stated one-third of the radius of ball part 20. Other distances may be selected for "x" as long as the centers 34 and 36 are not concentric. Ball part 30 comprises a conventional high bouncing type ball of the type that might also be utilized to play, practice or train with for baseball. Ball part 30 is made of an elastic rubber (silicone, thermoplastic elastomer, or the like) and is referred to as high bouncing because when dropped from a height of 149 cm onto a marble floor ball 30 will rebound at about 112 cm. Ball 30, for example, may be 3.7 cm in diameter, 24.5 grams in weight and 0.923 gr/cc in density. It should be understood that balls with other sizes, weights and densities and made from other materials could be utilized to form composite ball 10 as long as the balls for first ball part 20 are sufficiently larger than those utilized for second ball part 30 so that ball part 30 may be imbedded within ball part 20 and so that the ball parts initially possess different bounce characteristics.

One method for fabricating composite ball 10 would be to sever first ball part 20 at a location commensurate with where second ball part 30 is to be located. A cavity 40 equal to the size of second ball part 30 is then formed in first ball part 20. Second ball part 30 is then imbedded within first ball 20 and first ball part 20 is then re-assembled and secured together so that ball part 30 is imbedded therewithin. In re-assembling first ball part 20 the parts thereof, that were severed to facilitate formation of cavity 40 and disposition of second ball part 30 therein, are secured together by suitable means such as a clear silicone glue of the type with a chemical composition methoxy polydimethylsiloxane that is left at least over night to cure the glue at room temperature. Second ball part 30 may be also coated with such silicone glue, heavily if desired, prior to being placed within cavity 40.

Resulting composite ball 10, fabricated as described above, will bounce in unpredictable directions and to unpredictable heights; for example between 25 to 38 cm when dropped from the same 149 cm height onto the same marble floor as described above for first ball part 20 and second ball part 30.

Alternative methods of manufacture may be utilized for composite ball 10 including fabricating sponge ball part 20 with a high bouncing type ball part 30 disposed within sponge ball part 20 as sponge ball part 20 is formed.

Figure 2:
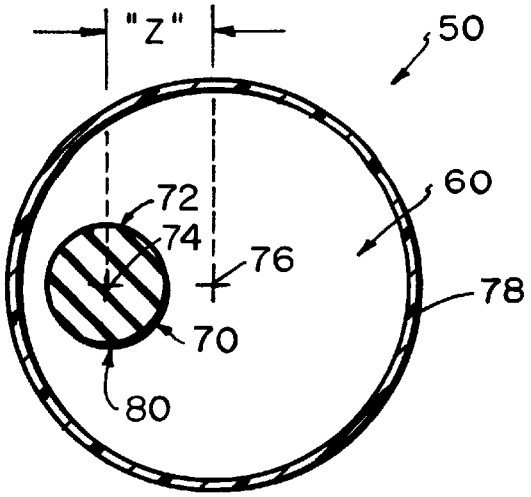
FIG. 2 is a schematic of an alternative construction of a composite ball also incorporating the instant invention.

With reference to FIG. 2 there is generally shown at 50 a composite ball also incorporating the instant invention. A first component or ball part 60, of composite ball 50, comprises a conventional ball of the high bouncing type, such as ball 30 of ball 10 of FIG. 1. Ball part 60 could thus be of the same size, weight and density as ball 30 (i.e. 3.7 cm in diameter, 24.5 grams in weight and 0.923 gr/cc in density) and before being incorporated into composite ball 50 would display a bouncing height similar to ball part 30 if dropped from a height of 149 cm onto a marble floor (i.e. about 112 cm). Ball part 60 like ball part 30 could also be fabricated as a solid ball and from an elastic rubber such as silicone or thermoplastic elastomer.

A second ball part 70 is formed or disposed within first ball part 70 at a location 72 such that a center 74 for ball part 70 is spaced from a center 76 of first ball part 60 by a predetermined distance "Z"; which, in this instance, is about one-half of the distance between center 76 of first ball part 60 and a surface 78 of ball part 60, or as it may be otherwise stated one-half of the radius of ball part 60. Other distances may be selected for "Z" as long as centers 74 and 76 are not concentric.

Ball part 70 is formed as a spherical cavity or void 80 disposed within ball part 60 and located as described above. In doing so only about five percent of the weight of ball part 60 is removed. Ball part or void 70 may be formed with different non-spherical configurations and otherwise located within ball part 60. The final weight of composite ball 50 may be controlled by the volume of void or ball part 70. Thus, air serves as the material for ball part 70.

Composite ball 50 may be fabricated by severing ball part 60 at the appropriate position and by forming cavity or ball part 70 by suitable and conventional means and methods. The parts of ball part 60 are thereafter secured together by suitable and conventional means, such as an adhesive like a clear silicone glue with a chemical composition, methoxy polydimethylsiloxane, which is thereafter allowed to cure about one day and at room temperature.

Resulting composite ball 50 will have unpredictable bouncing direction, a different and unpredictable rebound direction, and an unpredictable rebound height between 91 and 107 cm (when dropped from 149 cm onto a marble floor). While composite ball 50 is shown with only a single ball part or void 70 it may just as well be fabricated with multiple voids or ball parts 70.

An alternative method of fabricating composite ball 50 would utilize a gas-assisted injection molding process wherein a pressurized gas is injected inside the molten polymer during the molding of first ball part 60. The gas would be injected inside the molten polymer through the nozzle of the injection molder or through the mold before the molten polymer solidified inside the mold cavity. The injected gas creates void 70 and keeps the molten polymer pressed against the mold cavity wall during cooling. Undesirable shrinkage mark or warpage due to thermal shrinkage is avoided by this process even for thick parts. The size, shape and location of void 70 inside composite ball 50 can be controlled by the design and processing variables associated with this gas-assisted injected molding. The degree of unpredictability in the direction and height of rebound of composite ball 50 will be related to the size, shape and location of void or second ball part 70 within first ball part 60 of composite ball 50.

From the above description it will thus be seen that there has been provided new and novel composite balls for play and sports training activities; which composite balls are relatively simple in construction and to fabricate and will display unpredictable bouncing height and direction.

It is understood that although there has been shown and described preferred embodiments of the invention that various modifications may be made in the details thereof without departing from the spirit as comprehended by the following claims.

What is claimed is:

1. A composite resilient ball primarily for bouncing, comprising:

(a) first ball part means forming part of said composite resilient ball and having first resilient characteristics including a predetermined bounce characteristic; and (b) second ball part means forming part of said composite resilient ball and having second resilient characteristics of which are different from said resilient characteristics of said first ball part means; and (c) said second ball part means being disposed within said first ball part means, said second ball part means displaced away from the center of the first ball part means, so that the composite ball possesses at least unpredictable bounce characteristics.

2. The composite ball of claim 1 wherein said resilient characteristics of said first ball part means and said resilient characteristics of said second ball part means differ at least as to material, size and weight.

3. The composite ball of claim 2, wherein said second ball part means is disposed so that the center thereof is spaced a predetermined distance from the center of said first ball part means.

4. The composite ball of claim 3 wherein said first ball part means includes a periphery and said second ball part means is also spaced from said periphery of said first ball part means.

5. The composite ball of claim 4, wherein said predetermined distance is substantially one-third the length of the radius of said first ball part means.

6. The composite ball of claim 2, wherein said material of said first ball part means is a sponge rubber and the material of said second ball part means is an elastic rubber and wherein said first ball part means is of relatively larger diameter than the diameter of said first ball part means.

7. The composite ball of claim 6, wherein said material of said second ball part means is a silicone or thermoplastic elastomer.

8. The composite ball of claim 7, wherein said resilient characteristics of said second ball part means possesses relatively greater bounce characteristics than said first ball part means prior to combination thereof to form the composite ball.

9. The composite ball of claim 2, wherein said material of said first ball part means is an elastic rubber and the material of said second ball part means is air.

10. The composite ball of claim 9, wherein said center of said first ball part means and said center of said second ball part means are spaced by a predetermined distance which is substantially one-half the radius of said first ball part means.

11. The composite ball of claim 10, wherein said second ball part means comprises an air filled void formed within said first ball part means.

* * * * *